US005722901A

United States Patent [19]

Barron et al.

[11] Patent Number: 5,722,901

[45] Date of Patent: Mar. 3, 1998

[54] RELEASABLE FASTENING STRUCTURE FOR TRIAL GOLF CLUB SHAFTS AND HEADS

[76] Inventors: John R. Barron, 6512 E. Sprague Ave., Spokane, Wash. 99212; Leo Ohanesian, 3311 E. 65th Ave., Spokane, Wash. 99223

[21] Appl. No.: 798,558

[22] Filed: Feb. 11, 1997

[51] Int. Cl.[6] ..... A63B 53/02

[52] U.S. Cl. ..... 473/305; 473/307

[58] Field of Search ..... 473/305, 306, 473/307, 308, 309, 310, 311, 312, 313, 314, 315, 325, 288

[56] References Cited

U.S. PATENT DOCUMENTS

| | | | |
|---|---|---|---|
| 796,802 | 8/1905 | Brown | 473/308 |
| 1,266,529 | 5/1918 | Mattern | 473/312 |
| 1,589,707 | 6/1926 | Kraeuter . | |
| 1,623,523 | 4/1927 | Bourke | 473/307 |
| 1,669,836 | 5/1928 | Neuberth . | |
| 1,787,415 | 12/1930 | Washington | 473/315 |
| 1,802,507 | 4/1931 | Hadden | 473/306 |
| 1,844,812 | 2/1932 | Thorpe | 473/308 |
| 2,060,872 | 11/1936 | Kraeuter . | |
| 2,066,442 | 1/1937 | Wright . | |
| 3,170,691 | 2/1965 | Pritchard . | |
| 3,171,691 | 3/1965 | Pritchard . | |
| 3,743,324 | 7/1973 | Schwarz et al. . | |
| 3,829,092 | 8/1974 | Arkin | 473/306 |
| 4,597,577 | 7/1986 | Lamanna | 473/307 |
| 5,039,098 | 8/1991 | Pelz . | |
| 5,429,358 | 7/1995 | Rigal et al. . | |
| 5,433,442 | 7/1995 | Walker | 473/306 |
| 5,513,844 | 5/1996 | Ashcraft et al. . | |
| 5,538,246 | 7/1996 | Dekura . | |

*Primary Examiner*—Sebastiano Passaniti
*Attorney, Agent, or Firm*—Keith S. Bergman

[57] ABSTRACT

A releasable fastening structure for quick assemblage and disassemblage of golf clubs and shafts for trial purposes provides club heads with hosels carrying diametrically extending fastening pins to interconnect with cooperating shafts defining fastenably interconnecting channels. The head end portion of cooperating shafts define "U" shaped channels to receive the fastening pin in releasable interconnection upon axial and rotary motion in the hosel channel. A spring in the hosel channel inwardly of the fastening pin biases a shaft therein outwardly to maintain fastenable interconnection after establishment, but allows manually generated, axially inward motion for quick assembly and disassembly.

2 Claims, 1 Drawing Sheet

RELEASABLE FASTENING STRUCTURE FOR TRIAL GOLF CLUB SHAFTS AND HEADS

II. BACKGROUND OF INVENTION

IIA. RELATED APPLICATIONS

There are no applications related hereto heretofore filed in this or any foreign country.

IIB. FIELD OF INVENTION

This invention relates generally to golf clubs, and more particularly to a fastening structure that allows rapid connect and release of shafts and heads of trial clubs.

IIC. BACKGROUND AND DESCRIPTION OF PRIOR ART

In modern golf as the sophistication of both players and their equipment has increased it has become common to use custom-made golf clubs that are created from various components to meet the needs and satisfy the desires of individual players. In creating custom golf clubs, there are various types of components that may form club combinations and the types of components themselves have parametric variations which give rise to an even greater number of possible permutations. With such a varied assortment of components and parametric variations, it is difficult for a club user to determine specific combinations of potential components that may best suit him and the only practical method of aiding this determination is to provide samples of clubs embodying the components so that they may be tried to determine desirability. To provide permanently assembled clubs for this purpose would require a set of more than a thousand golf clubs which is not within the realms of economic viability to fulfill this purpose. The instant invention seeks to solve this problem by providing a releasable fastening structure shared by a group of golf club shafts and heads to allow releasable interconnection of those elements to provide clubs for trial by a user to aid in choosing club components for a permanently assembled set of clubs such as are presently used in the modern day golf game.

Various structures for interconnecting golf club parts, and particularly heads and shafts, have heretofore been known for particular purposes, but in general those structures have not been well adaptable to the instant purpose of providing trial clubs by reason of their specialized nature. The interconnecting structure for use with trial clubs must provide a quickly and easily fastenable and releasable connection that yet is secure enough to allow the club to be used in its normal operative fashion so that a user may determine the particular characteristics of that club. Many connecting structures heretofore known have been of a semi-permanent nature, have taken a substantial amount of time to accomplish their interconnection and in general have required the use of tools or particular apparatus to accomplish the connection and release. The instant structure in contradistinction provides a simple and quick connection that is accomplished by manual manipulation of the parts without the use of any ancillary tools.

Additionally, fastening structure for trial golf clubs must provide substantially the same security of interconnection and the same physical reactions as will be provided by the same components when and if they are physically interconnected by normal permanent connecting methods to form permanent clubs. If the interconnection is not secure, the club during use will feel differently to the user than it would with a secure interconnection. This reaction is particularly important in the trial of custom golf clubs as the users involved with such clubs normally are reasonably expert and the aesthetics of the feel of golf clubs are not only readily discernible by such users but also are quite important to users in choosing golf club structures.

To provide viable trial clubs not only must the overall weight of a trial club that embodies the releasable fastening structure be substantially the same as an ultimate permanently assembled club, but also the static and dynamic balance and inertial points must be substantially the same. The instant fastening structure generally satisfies this requirement by reason of its nature and if modification is required allows optional use of weights and a sleeve at and about the point of interconnection of a shaft and hosel to further adjust mass and both static and dynamic balance.

The instant connecting structure allows its inclusion in existing golf club shafts and head structures without requiring special manufacturing configurations of either and without modification or change of the surface appearance of either since the connecting structure is carried by a club hosel and shaft in their area of interconnection which is not visibly discernible. Our connecting structure also may be used with either tubular or solid type shafts in the same form and without requiring the use of plugs or other added structures in the channel of a hollow club shaft. The instant connecting structure also allows the use of elongate sleeves carried in a hosel or on the end portion of a shaft, between the shaft and a hosel, and about the shaft outwardly of the hosel to provide the benefits of such sleeves as heretofore known in the golf club art.

Releasable fastening structures for interconnecting golf club shafts and heads to create trial clubs have heretofore been known in the patent literature, as evidenced by U.S. Pat. No. 5,513,844 issued to Ashcraft, et al., on May 7, 1996 and U.S. Pat. No. 5,039,098 issued to Pelz on Aug. 13, 1991. Both of these fastening systems require the use of tools for the fastening and release of interconnection between a head and shaft in distinguishment from the instant connecting structure which is connected and disconnected by manual manipulation of the shaft and head and without the use of tools. The connecting structures of these two references also require the modification of the essential structure of club heads, shafts or both in the manufacturing process, so that the two may fastenably interfit with each other, whereas the instant connecting system does not require any such manufacturing modifications but rather makes use of ordinary heads and shafts of modern commerce with appropriate modification after manufacture.

Our invention resides not in any one of these features individually, but rather in the synergistic combination of all of its structures that give rise to the functions necessarily flowing therefrom as herein specified and claimed.

III. SUMMARY OF INVENTION

Our fastening structure is defined in the adjacent portions of the hosel of a golf club head and the end portion of an associated shaft to be interconnected therein. The hosel provides a cylindrical fastening pin carried spacedly below the outer end portion and extending diametrically through the shaft channel, with a compression spring carried in the shaft channel inwardly of the fastening pin. The interconnectable shaft in its head end portion defines a channel formed by a diametrically orientated first slot extending spacedly inwardly from the head end with a second "L" shaped slot defining a horizontal leg extending perpendicularly from communication with the inner end portion of the first slot and a vertical leg extending perpendicularly toward the head end of the shaft from the vertical leg of the second slot to terminate spacedly distant from the head end of the shaft. All slots are incrementally wider than the diameter of the fastening pin and extend in diametrical opposition through the shaft, so that the shaft may be placed in the channel of the hosel and the fastening pin moved through the first slot thence through the horizontal leg of the second slot and thence in the vertical leg of the second slot to be to be there fastenably maintained and interconnected by bias of the compression spring in the hosel channel. The shaft may be released by moving it axially inward in the hosel channel to overcome the bias of the compression spring and rotating it sufficiently to allow the fastening pin to move through the horizontal leg of the second slot and into the first slot so that the shaft may then be removed from the club hosel. An additional sleeve may be carried in the hosel or by the shaft to extend about the end portion of a shaft that is carried in or outwardly adjacent to the hosel.

In providing such a structure, it is:

A principal object to create a releasable fastening structure for use in trial golf clubs to allow rapid and secure interconnection and disconnection of shafts and heads by manual manipulation and without the use of tools.

It is a further object to provide such a fastening structure that may be established in the hosels of golf club heads and defined in the ends of shafts without requiring structural modifications of those elements in the manufacturing processes of either.

A still further object is to provide such a fastening structure that maintains substantially the same mass and both static and dynamic balance of heads and shafts interconnected by the structure as would exist in such heads and shafts if permanently interconnected, to provide the same feel of a trial club as would exist in a club formed by permanently interconnection of the same components.

A still further object is to provide such a fastening structure that may be used with tubular sleeves extending from a hosel over a shaft therein and spacedly outwardly from the hosel.

A still further object is to provide such a connecting structure that is of new and novel design, of rugged and durable nature, of simple and economic manufacture and one otherwise well adapted for the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement, with only one preferred and practical embodiment being illustrated in the accompanying drawings and specified as is required.

IV. BRIEF DESCRIPTION OF DRAWINGS

In the accompanying drawings which form a part hereof and wherein like numbers of reference refer to similar parts throughout:

V. DESCRIPTION OF PREFERRED EMBODIMENT

Figure 2:
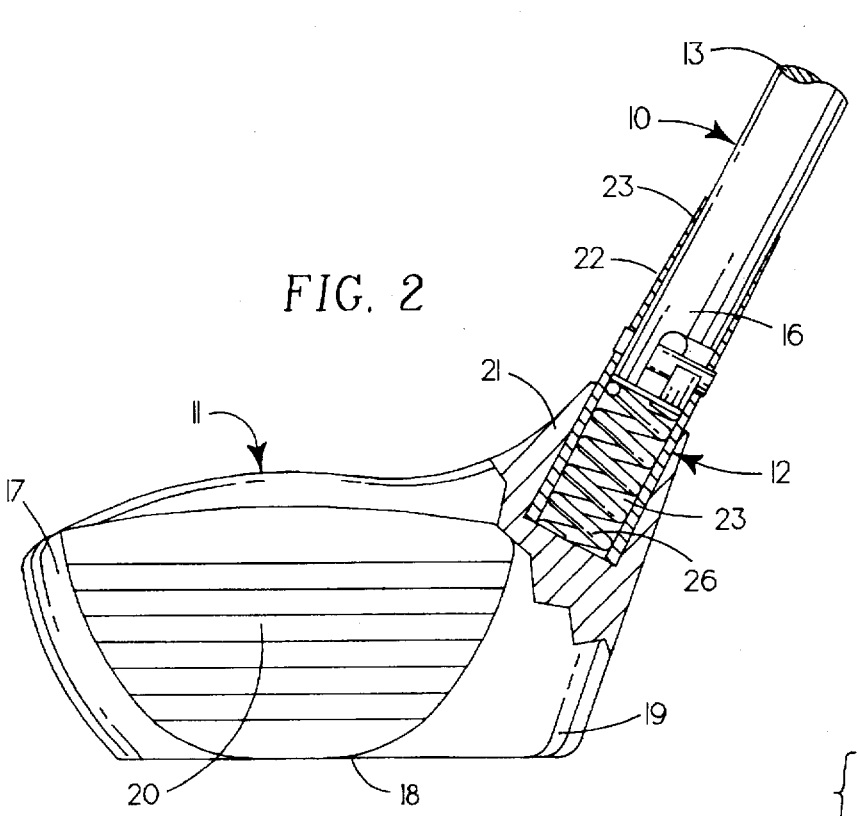
FIG. 2 is a partial, cut-away orthographic view of the golf club of FIG. 1 showing the various elements of our fastening structure, their configuration and relationship.

Our invention generally provides connecting structure 12 defined in adjacent interconnecting portions of golf club shaft 10 and head 11.

Golf club shafts 10 vary in their length, suppleness and internal construction, but all share the same general configurational essentials of a tapering cylindrical shaft 13 with a diametrically larger, resilient grip 14 in the upper end portion and some type of cap structure 15 at the upper end. The shaft 13 may be of solid construction as is common with shafts formed of various polymeric and resinous plastics and their compositions or of a tubular nature as is common with various metallic and composite shafts. The lower end portion 16 of the shaft 13 defines a cylindrical periphery, in some shafts of a slightly tapering nature and in others of a straight sided cylindrical nature, to interfit within a shaft channel defined in the hosel of a club head. Golf club shafts vary through a somewhat limited range in their length and vary widely as to other physical parameters such as rigidity, density, elasticity and the like.

Golf club head 11 defines toe portion 17, sole 18, heel portion 19 and flat face 20, with hosel 21 extending therefrom to interconnect the lower end portion 16 of a shaft 13. The hosel 21 is not particularly standardized in its detail and may take various forms including especially an elongate neck that is integral with the other head portions and a neck, especially of a shorter length, carrying an elongate tubular collar 22 extending spacedly outwardly from the hosel and over a portion of a shaft 13 carried therein. In either case, however, the collar 22 and hosel 21 define medial channel 23 to receive the lower end portion 16 of a shaft 13 in an interconnecting fit. The heads of various golf clubs comprise approximately sixteen generally recognized types comprising five types of woods, ten types of irons and a putter. Particular heads of any type may vary from others of the same type so as to provide many combinations of head and shaft types with a substantially greater number of permutations of head and shaft variations, notwithstanding that golf rules generally allow no more than fourteen clubs to be carried by a player during a particular round of golf.

Figure 3:
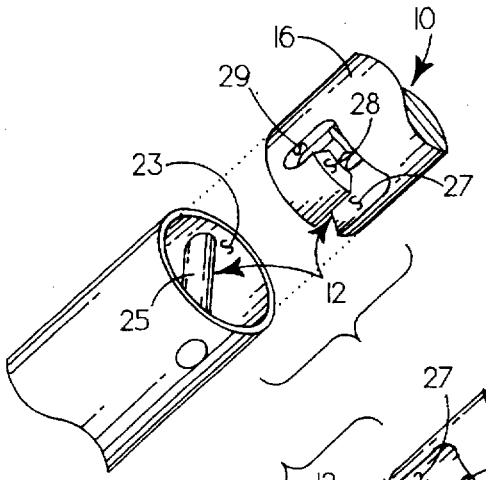
FIG. 3 is a partial isometric view of the fastening structure of the club of FIG. 1 with the club and head separated to show its configuration and method of assembly.
Figure 4:
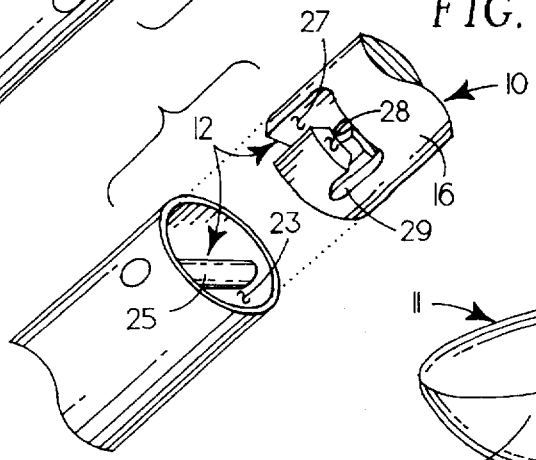
FIG. 4 is a view similar to FIG. 3 of the side not seen in FIG. 3.
Figure 1:
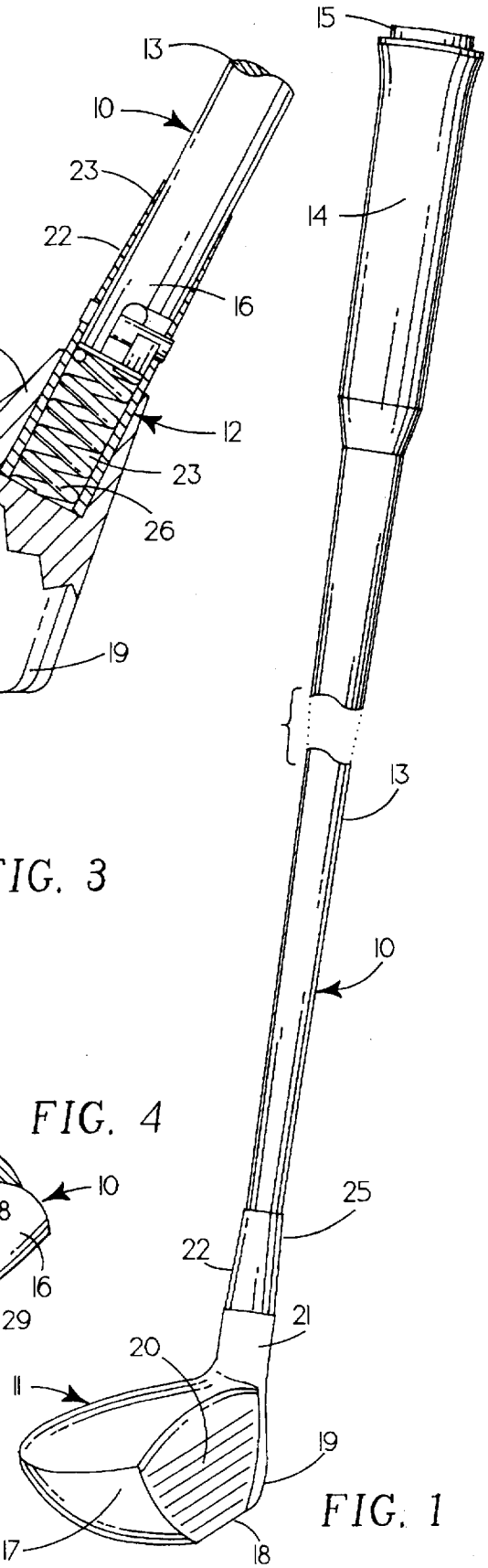
FIG. 1 is a partial isometric view of a golf club embodying our fastening system.

Our connecting structure is seen in FIGS. 2–4 to provide fastening pin 25, in the instance illustrated of cylindrical configuration, extending diametrically through the medial channel 23 of hosel 21, tubular collar 22, or both as the case may be, spacedly outwardly from the inner end portion 24 of the medial channel 23. In a golf club head construction wherein the medial channel 23 extends completely through the head to define an orifice in the sole 18, as it sometimes does, it is necessary in using our invention to provide a plug (not shown) in the lower portion of the medial channel or some other mechanical device such as a shoulder or pin to maintain the lower portion of a compression spring within the lower portion of the channel 23.

Cylindrical compression spring 26 is carried in medial channel 23 between inner end portion 24 and fastening pin 25. This spring 26 preferably has a length such that in its relaxed condition it is at least as long as the distance between the adjacent surfaces of inner end portion 23 and fastening pin 25, and it should have sufficient elasticity as to require a force of at least a few pounds to cause deformation, so that it maintains the interconnection of a shaft with a head when the elements are in the interconnected mode. The external diameter of the spring 26 should be incrementally smaller than medial channel 23 in which the spring is carried to allow free motion of the spring. The purpose of this spring 26 is merely to maintain a golf club shaft thereabove biased in an upward or outward axial direction and because of this, other known biasing devices may be used for this purpose and are within the ambit and scope of our invention.

The lower end portion 16 of shaft 13 defines a shaft channel structure that interconnects, within medial channel 23 of the hosel, with the portion of fastening pin 25 therein. The shaft channel 23 comprises a first diametrically extending slot 27 defined a spaced distance inwardly from the lower end of shaft 13. This first slot 27 has a width incrementally greater than the diameter of fastening pin 25 to allow passage of the fastening pin therethrough. A second horizontal slot 28 of at least as great width as the first slot is defined with radial orientation to communicate with the inner portion of the first slot 27 and extend angularly therefrom. The angular length of the slot is not critical so long as it is sufficient to allow definition of a third vertical slot spacedly distant from the first slot and to provide sufficient shaft material between the vertical slots for appropriate strength and rigidity, which generally requires an angular extent of approximately sixty degrees. A third diametrically orientated vertical slot 29 of the same width as the first slot communicates from the end portion of the second slot distal from the first vertical slot spacedly downwardly a distance at least as great as the diameter of fastening pin 25, but less than the distance from the second horizontal slot to the lower end of shaft 13. These interconnecting slots then in combination provide the somewhat "U" shaped channel shown in FIGS. 3 and 4 to allow releasable interconnection of the lower end portion 16 of the shaft 13 with the fastening pin 25 carried by the hosel 22.

A shaft defining the interconnecting slots 27, 28 and 29 is interconnected to a compatible head by inserting the lower end of a shaft 13 into the upper end portion of hosel 21 or tubular collar 22, as the case may be, and rotatably moving the two structures relative to each other until fastening pin 25 is aligned with first vertical slot 27. The shaft 13 then is moved inwardly within medial channel 23 against the bias of compression spring 26 until the upper outer portion of the fastening pin 25 stops this motion by reason of contact with the innermost portion of vertical slot 27. The shaft 13 then is rotated relative to the head so that fastening pin 25 moves through second horizontal slot 28 to the end of that slot distal from the first slot. When in this position, any manual force between the head and shaft is released and the bias of compression spring 26 is allowed to move the shaft outwardly relative to medial channel 23 so that fastening pin 25 comes to rest in the lower end portion of third vertical slot 29 distal from slot 28. The shaft is then maintained in releasable interconnection with the club head by the bias of spring 26.

To release an interconnected shaft and head having the instant connecting structure, the shaft 10 is manually moved inwardly in hosel channel 23 toward the head until fastening pin 25 stops this motion by passing into the second horizontal slot 28. The shaft then is rotated so that fastening pin 25 moves through horizontal slot 28 toward and into first vertical slot 27. The force overcoming the bias of compression spring 26 is then released and the shaft moved manually, and by the spring bias, outwardly from the medial channel 23. With this fastening structure, a plurality of heads and shafts having the cooperating interfitting portions of the instant fastening structure may be releasably interconnected with each other as desired to allow various combinations of shaft and head types and permutations of parametric variations within the types to provide trial clubs for actual use prior to final assemblage.

It is to be noted that our fastening system changes the overall mass of a club structure only slightly, if at all, as the added fastening pin and compression spring in general tend to compensate for mass removed in defining the fastening slots in the lower end portion of the club shaft. It is further to be noted that this mass addition and removal remains in substantially the same area so that there is little, if any, change in either static or dynamic balance of a club having our connecting structure. If mass adjustments are required in a connecting system having particular parameters, it should further be noted that the size and positioning of the fastening pin and compression spring may be varied and this will cause or allow corresponding variance in the size of slots defined in the golf club shaft, and additional weights may be added or additional material removed to allow adjustment of mass of a trial club and adjustment of points of dynamic and static balance according to known engineering principles.

It is further to be noted that the connecting structure described may be used with golf club shafts of either solid or tubular types and with club heads having an integral hosel or hosel with a tubular connecting collar.

The foregoing description of our invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described our invention, what we desire to protect by Letters Patent, and

What we claim is:

1. A releasable connecting structure for golf club shafts and heads, having a hosel defining a medial channel with an inner end to receive a first end portion of the shaft, comprising in combination:

a golf club head having a fastening pin carried by the hosel to extend diametrically through the medial channel defined therein spacedly distant from the inner end and a compression spring carried in the medial channel between the inner end and the fastening pin for biasing a shaft in the medial channel outwardly from the inner end, and a golf club shaft having channel structure defined in the first end portion carried in the hosel, said channel structure having a diametrically orientated first slot, with a width incrementally greater than the diameter of the fastening pin, extending spacedly inwardly from the first end of the shaft to interconnect with a second radially extending slot having width at least as great as the length of the first slot and a length greater than the width to interconnect with a third vertical slot having a width at least as great as the first slot and extending with diametrical orientation toward the first end of the shaft spacedly distant therefrom.

2. The connecting structure of claim 1 further having a tubular collar extending about the first end portion of the shaft and within the medial channel of the hosel.

* * * * *